US006800339B2

(12) United States Patent
Motz et al.

(10) Patent No.: US 6,800,339 B2
(45) Date of Patent: Oct. 5, 2004

(54) FILLED SYNTHETIC TURF WITH BALLAST LAYER

(75) Inventors: Joseph E. Motz, Cincinnati, OH (US); Mark A. Heinlein, Cincinnati, OH (US); Stephen L. Linville, Rydal, GA (US)

(73) Assignee: Coevin Licensing, LLC, Chatsworth, GA (US)

( * ) Notice: Subject to any disclaimer, the term of this patent is extended or adjusted under 35 U.S.C. 154(b) by 0 days.

(21) Appl. No.: 10/634,217

(22) Filed: Aug. 5, 2003

(65) Prior Publication Data

US 2004/0028841 A1 Feb. 12, 2004

Related U.S. Application Data

(63) Continuation of application No. 10/028,221, filed on Dec. 21, 2001, now abandoned.

(51) Int. Cl.[7] ..... A01N 3/00

(52) U.S. Cl. ..... 428/17; 428/85; 428/87; 428/143; 428/147; 428/149; 428/150; 405/36

(58) Field of Search ..... 428/17, 15, 85, 428/87, 143, 147, 149, 150, 220, 332, 323, 327, 325, 492; 405/36

(56) References Cited

U.S. PATENT DOCUMENTS

| | | | | |
|---|---|---|---|---|
| 3,740,303 | A | | 6/1973 | Alderson et al. |
| 3,908,385 | A | | 9/1975 | Daniel et al. |
| 3,995,079 | A | | 11/1976 | Haas, Jr. |
| 4,044,179 | A | | 8/1977 | Haas, Jr. |
| 4,337,283 | A | | 6/1982 | Haas, Jr. |
| 4,389,435 | A | | 6/1983 | Haas, Jr. |
| 4,396,653 | A | | 8/1983 | Tomarin |
| 4,637,942 | A | | 1/1987 | Tomarin |
| 4,913,596 | A | | 4/1990 | Lambert, III |
| 5,306,317 | A | | 4/1994 | Yoshizaki |
| 5,380,574 | A | | 1/1995 | Katoh et al. |
| 5,460,867 | A | | 10/1995 | Magnuson et al. |
| 5,643,482 | A | | 7/1997 | Sandelman et al. |
| 5,958,527 | A | | 9/1999 | Prevost |
| 5,962,101 | A | | 10/1999 | Irwin et al. |
| 5,976,645 | A | | 11/1999 | Daluise et al. |
| 6,048,282 | A | | 4/2000 | Prevost et al. |
| 6,094,860 | A | | 8/2000 | Motz et al. |
| 6,221,445 | B1 | | 4/2001 | Jones |
| 6,295,756 | B1 | * | 10/2001 | Bergevin ..... 47/1.01 R |
| 6,299,959 | B1 | | 10/2001 | Squires et al. |
| 6,338,885 | B1 | | 1/2002 | Prevost |
| 6,472,041 | B1 | * | 10/2002 | Burke ..... 428/86 |
| 6,551,689 | B1 | * | 4/2003 | Prevost ..... 428/143 |
| 2002/0028307 | A1 | * | 3/2002 | Prevost ..... 428/17 |

FOREIGN PATENT DOCUMENTS

| | | |
|---|---|---|
| DE | 4304711 A | 9/1993 |
| EP | 0174755 | 3/1986 |
| JP | 03350052 | 6/1993 |
| JP | 05336778 | 1/1995 |
| JP | 10033027 | 8/1999 |
| JP | 2001-336110 | 7/2001 |
| WO | WO98/40559 | 9/1998 |
| WO | WO 01/98589 A2 | 12/2001 |

* cited by examiner

*Primary Examiner*—Deborah Jones
*Assistant Examiner*—Wendy Boss
(74) *Attorney, Agent, or Firm*—Wood, Herron & Evans, L.L.P.

(57) ABSTRACT

A synthetic turf comprises a backing with a plurality of pile filaments secured to the backing and extending upwardly therefrom and filled with particulate fill material. The fill material comprises a lower ballast layer of gravel residing on the backing and an upper layer of resilient particles above the lower layer. The lower layer of gravel provides weight and stability to hold down the synthetic turf without migrating to the surface. The upper layer provides cushioning and uniform resilience for the synthetic turf while the pile filaments create a grass-like appearance for the playing surface.

27 Claims, 4 Drawing Sheets

FILLED SYNTHETIC TURF WITH BALLAST LAYER

CROSS REFERENCE TO RELATED APPLICATIONS

This application is a continuation of U.S. patent application Ser. No. 10/028,221 filed Dec. 21, 2001 entitled "Filled Synthetic Turf With Ballast Layer", now abandoned, which application is fully incorporated herein.

FIELD OF THE INVENTION

This invention relates to synthetic turfs for athletic fields and, more particularly, to a synthetic turf filled with particulate material so as to give the field stability and resiliency.

BACKGROUND OF THE INVENTION

A natural grass turf covering has traditionally been cultivated on playing surfaces for athletic games or events. In addition to looking good, natural grass turf provides inherent resiliency and cushioning, thereby minimizing the risk of injury due to an athlete's impact with the turf. Such natural grass turf coverings have traditionally been used to cover American football or soccer fields. Many athletes participating in these high impact sports desire a surface with a high degree of resiliency such as is provided by a natural grass turf covering.

However, maintenance of natural grass turf on athletic playing areas can be expensive and time consuming. Natural grass does not grow well within shaded areas like those within indoor or partially enclosed stadiums. In addition, some "heavy traffic" locations on the playing field are susceptible to wearing out or deteriorating due to continuous or excessive wear. These worn areas may become muddy and slippery after the natural grass dies, increasing the likelihood of injury.

Therefore, various types of synthetic turf have been developed and installed on athletic playing surfaces, particularly surfaces located within indoor stadiums. Generally, these various synthetic turf surfaces reduce the expense of maintaining athletic playing surfaces and increase the durability of the turf surface. Synthetic turf generally comprises a flexible backing and a plurality of grass-like pile filaments or fibers extending upwardly from the backing. The flexible backing is typically laid on a foundation or compacted substrate, such as crushed stone or stabilized base material.

Most earlier forms of synthetic turf relied solely on the backing and the pile filaments or fibers as the playing surface. ASTROTURF synthetic turf is an example of this type of artificial turf.

In order to give the synthetic turf a desired degree of resiliency and stability, various formulations of granular fill material may be placed between or among the upstanding pile filaments of the synthetic turf. This granular fill material extends upwardly from the upper surface of the backing to a height below the tops of the pile filaments, thereby leaving upper portions of the pile filaments exposed for aesthetic purposes, among others. The granular fill material helps maintain in a substantially upright condition the filaments of the synthetic turf. This granular fill material has been sand, crushed slag particles, resilient foam, crumb rubber particles, sand or various combinations thereof.

U.S. Pat. No. 3,995,079 discloses a filled synthetic turf for golf greens, the granular fill material being granulated coal slag, crushed flint or crushed granite. The difficulty with the use of these particles as fill material is that they are very abrasive. This inherent abrasiveness increases the probability of scrapes or abrasions to persons falling upon the filled synthetic turf.

U.S. Pat. No. 4,044,179 discloses a filled synthetic turf for athletic playing surfaces, wherein the granular fill material is sand with a small amount of moisture retaining material. The difficulty with the use of sand as the fill is that sand compacts over time and use, resulting in a filled synthetic turf which is harder than desired. Because such playing surfaces are commonly used for high impact sports, the harder the field, the greater the likelihood of injury for the players using the field. Another difficulty with sand as the fill material is that sand retains water or moisture, thereby increasing the susceptibility of the filled synthetic turf to mold or mildew.

U.S. Pat. No. 4,337,283 discloses a filled synthetic turf for athletic playing surfaces, the granular fill material being a uniformly mixed combination of sand particles and resilient particles. One inherent difficulty with the use of such a mixture is that the resilient particles of the mixture tend to migrate to the top of the fill layer over time and repeated use with the sand tending to settle below the resilient particles. The sand that settles to the bottom of the fill layer tends to compact over time and use. This ultimately results in a layered synthetic turf which is harder and more abrasive than desired. A further disadvantage of such a uniformly mixed in fill is that some abrasive sand particles remain on the top surface of the synthetic turf. Players who come into contact with the sand particles experience skin abrasions.

U.S. Pat. No. 5,958,527 discloses a filled synthetic turf for athletic playing surfaces, the granular fill material comprising separate layers of sand particles and resilient particles. Difficulties with such a layered mixture are over time and repeated use, the sand at the bottom of the mixture tends to compact, causing the field to harden and inhibiting the vertical drainage of water off the field through the backing fo the filled synthetic turf.

Because filled synthetic turfs are subject to large temperature fluctuations, resulting in contraction and expansion of the turf backing, a fill comprising at least one layer of sand stabilizes the backing of the synthetic turf and provides weight to minimize lateral movement of the backing. However, over time and use, the sand particles are churned up or migrate toward the top of the field. The resilient particles in known filled synthetic turfs may migrate laterally due to the dynamic nature of the fill material. Athlete's cleats and other wear churns or mixes the fill material, resulting in a non-uniform playing surface with areas of exposed sand. Abrasive sand particles migrate to or find their way to the surface of the synthetic turf between the pile filaments. Whenever athletes fall or contact the turf, they are subject to cuts or abrasions due to the sand. The sand particles located at the surface of the fill material also are abrasive to the pile filaments of the synthetic turf, thereby degrading and/or fibrillating the tops of the pile filaments over time.

In addition, over time the sand compacts and becomes harder, an undesirable quality for a synthetic playing surface. Then, the resilient effect of the rubber particles is only temporary.

Therefore, it is an object of this invention to hold down the backing of a filled synthetic turf while eliminating the adverse effects of the use of sand.

It is another object of the present invention to extend the life of the resilient characteristics of a filled synthetic turf while still maintaining a high degree of directional stability for the synthetic backing.

It is still another object of the present invention to attain a long lasting, uniformly resilient athletic playing surface at a relatively low cost, and which is sufficiently versatile in design to accommodate a number of potential structural enhancements.

SUMMARY OF THE INVENTION

The present invention accomplishes these objects for a filled synthetic turf by using a particulate fill comprising at least some particles other than sand, i.e. particles such as gravel, to serve as a "ballast" to hold down the backing. In one aspect of the present invention, the filled synthetic turf has a multi-layered particulate fill, the lower layer being a heavy particulate such as gravel, to serve as a "ballast" to hold down the backing with an upper layer of resilient particles such as rubber over the ballast layer.

The filled synthetic turf comprises a backing residing on a foundation; a plurality of grass-like pile filaments secured to the backing and extending generally upwardly therefrom and a particulate fill material residing on the backing. The foundation may be crushed stone, dirt, asphalt, concrete, a pad or any other supporting surface. For drainage purposes, one or more drainage members may comprise part of the foundation.

The backing is preferably a flexible, water permeable material but may be made of any desired material. The backing may be a single layer of material or multiple layers of material joined together.

A plurality of grass-like pile filaments are secured to the backing and extend generally upwardly therefrom. The pile filaments preferably comprise synthetic ribbons of a selected length. They may be made of nylon, polyethylene or a polyethylene/polypropylene blend or any other material. They may be tufted, adhesively or otherwise joined to the backing. The pile filaments are preferably dyed or colored green so as to resemble the appearance of natural grass.

The fill material resides upon the backing and extends upwardly to a desired height which is below the tops of the pile filaments. This gives the field a green appearance, resembling natural grass. In addition, the particulate fill prevents the pile filaments from moving or becoming trampled down.

In one aspect of the present invention, the particulate fill material is divided into at least two layers: a first lower layer of ballast particles located on top of the backing and a second upper layer of resilient particles residing above the first lower layer. The first lower layer is comprised of particles such as gravel which provide weight for holding the backing in place. According to the United States Golf Association (U.S.G.A.), gravel is defined as particles having a diameter greater than 2 millimeters and sand is defined as particles having a diameter less than 2 millimeters. Fine gravel is defined by the U.S.G.A. as particles having a diameter between 2 and 3.4 millimeters. Although the U.S.G.A. uses diameter to measure particulate size, the particles of the present invention need not be symmetrical, i.e. have a diameter. They may be irregularly shaped. The ballast particles of the present invention are not intended to be limited to gravel. One type of ballast particle which is suitable for the present invention has the following analysis: 100 percent passing through a 0.5 inch or 12 millimeter sieve; not more than 10 percent passing through a number 10 or 2 millimeter sieve; and not more than 5 percent passing through a number 18 or 1 millimeter sieve.

The second upper layer provides resiliency for the synthetic turf. The resilient particles are preferably synthetic particles such as rubber particles, commonly referred to as crumb rubber.

In one aspect of the present invention, the height of the first lower layer is approximately equal to the height of the second upper layer. However, the first lower layer and the second upper layer may be any desired height.

In another aspect of the present invention, the particulate fill material is a mixture of ballast particles and resilient particles mixed together.

In another aspect of the present invention, the filled synthetic turf is multi-layered comprising at least two layers of filled synthetic turf. A surface layer of filled synthetic turf like the one described hereinabove, resides above a subsurface comprising another filled synthetic turf. The subsurface comprises a subsurface backing with a plurality of subsurface pile filaments extending upwardly therefrom to a desired height. A subsurface fill material resides on the subsurface backing to a desired vertical height relative to the desired height of the subsurface pile filaments. The subsurface fill material includes at least some resilient particles. In one aspect of the present invention the subsurface fill material may comprise gravel or sand as a lower layer and resilient particles such as rubber particles as an upper layer. The subsurface fill material may be held in place with a polymeric coating applied to the subsurface fill material and the subsurface pile filaments. Other binders such as latex or urethane may be used to hold the subsurface fill material in place.

In yet another aspect of the present invention, the composition of the subsurface fill material and the desired height of the subsurface pile filaments may be selected to achieve a desired degree of shock absorption for the subsurface and for the synthetic turf located thereabove.

In yet another aspect of the present invention tubing may reside in the subsurface fill material above the subsurface backing and below the tops of the subsurface pile filaments. The tubing is adapted to be operatively connected to a pump or other device to convey fluid within the tubing to selectively heat or cool the subsurface and thereby heat or cool the filled synthetic turf located above the subsurface.

BRIEF DESCRIPTION OF THE DRAWINGS

The objectives and features of the invention will become more readily apparent from the following detailed description taken in conjunction with the accompanying drawings in which:

FIG. 2C is a cross-sectional view of another embodiment of the present invention illustrating the filled synthetic turf of FIG. 1 residing on a subsurface comprising another filled synthetic turf like that of FIG. 1 but including a polymeric coating;

FIG. 2D is a cross-sectional view of another embodiment of the present invention illustrating a filled synthetic turf residing on a subsurface comprising another filled synthetic turf having tubing extending therethrough;

DETAILED DESCRIPTION OF THE INVENTION

Figure 1:
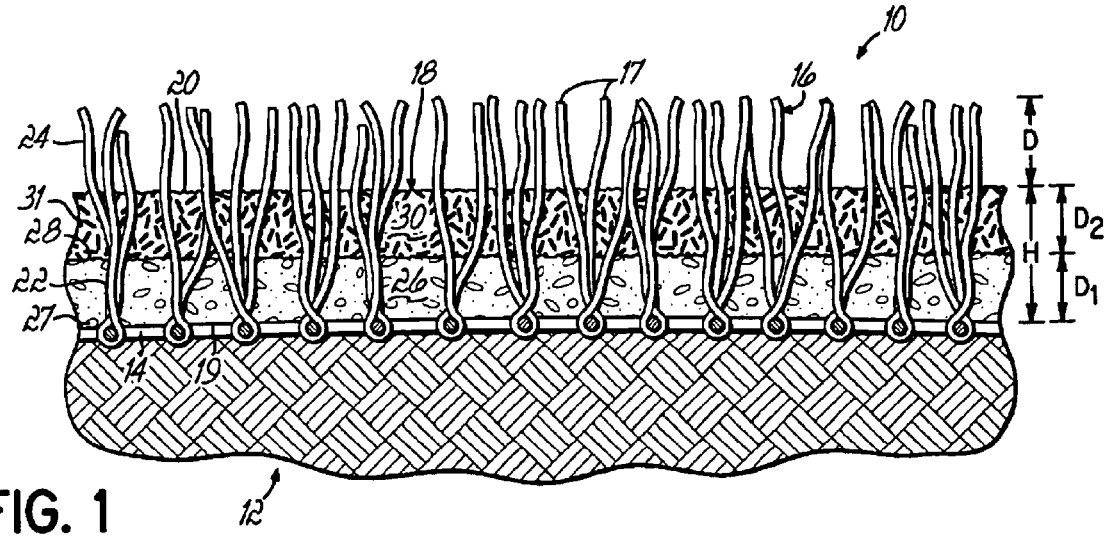
FIG. 1 is a cross-sectional view of the filled synthetic turf of the present invention.

Referring to the drawings, and particularly to FIG. 1, there is illustrated a filled synthetic turf 10 incorporating the present invention. FIG. 1 illustrates the filled synthetic turf 10 resting upon a foundation 12. The foundation 12 may take any one of many known forms and may include crushed stone or the like known in the athletic playing field industry.

Referring to FIG. 1, the filled synthetic turf 10 of the present invention comprises a backing 14 residing on the foundation 12. The backing 14 is preferably made of a flexible, water permeable material but may be made of any type of material such as foam. Although FIG. 1 illustrates a single layer of backing 14, the backing 14 may comprise multiple layers joined together in any known manner.

A plurality of grass-like pile filaments 16 are secured to the backing 14 and extend generally upwardly therefrom terminating at ends 17. The pile filaments 16 comprise synthetic ribbons of a selected length and may be made of nylon, polyethylene, a polyethylene/polypropylene blend, or any other appropriate material. The pile filaments 16 may be tufted to the backing 14, glued to the backing 14, or secured to the backing in other known manner.

A particulate fill material 18 resides on the backing 14 and extends upwardly from the backing 14 to a desired height H. As illustrated in FIG. 1, the particulate fill material 18 has a lower surface 19 residing on the backing 14 and an upper surface 20 which is located a fixed distance D below the tops or ends 17 of the pile filaments 16. Thus, each of the pile filaments 16 has a lower portion 22 located inside the particulate fill material 18 and an upper portion 24 located above the particulate fill material 18. The upper portions 24 give the playing surface a green appearance or look resembling natural grass. The particulate fill material 18 helps stabilize the pile filaments 16 in place and helps prevent the pile filaments 16 from becoming trampled or run-down.

As illustrated in FIG. 1, the particulate fill material 18 is divided into at least two layers. Referring to FIG. 1, the particulate fill material 18 includes a first lower layer 26 of ballast particles 27 such as gravel located on the backing 14 and extending upwardly from the backing 14 a distance $D_1$ to an upper surface 28. A second upper layer 30 of resilient particles 31 rests on the upper surface 28 of the first lower layer 26. The first lower layer 26 provides weight and stability for the synthetic turf and helps hold the backing 14 in its desired location. The second upper layer 30 of resilient particles 31 such as rubber provides resiliency for the synthetic filled turf 10. The second upper layer 30 is of a height $D_2$ extending from the upper surface 28 of the lower layer 26 to the upper surface 20 of the particulate fill material 18.

Figure 1A:
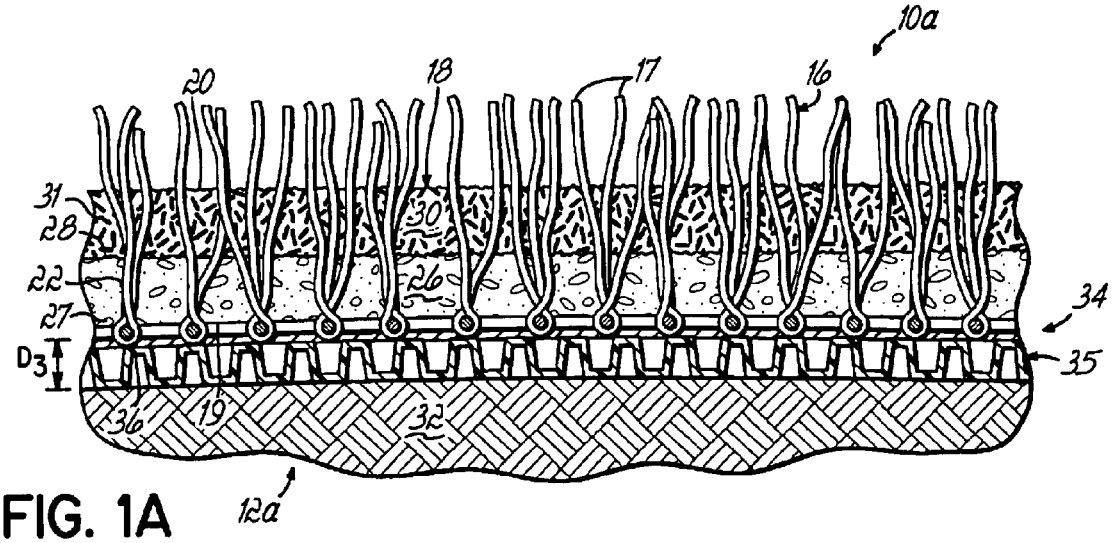
FIG. 1A is a cross-sectional view of the filled synthetic turf of FIG. 1 residing on a slightly different foundation.

Referring to FIG. 1A, a filled synthetic turf 10*a* similar to that of FIG. 1 is illustrated. However, the foundation 12*a* is slightly different from that illustrated in FIG. 1. The foundation 12*a* illustrated in FIG. 1A comprises a solid lower portion 32 and an upper portion 34 comprising at least one drainage member 35 extending upwardly from the lower portion 32 a distance $D_3$. The drainage member 35 is illustrated as having a plurality of indentations 36 and an upper piece 38. One type of drainage member which has been successfully used is manufactured by the Nickelon Corporation of Norcross, Ga., and sold under the trademark MIRADRI.

Figure 1B:
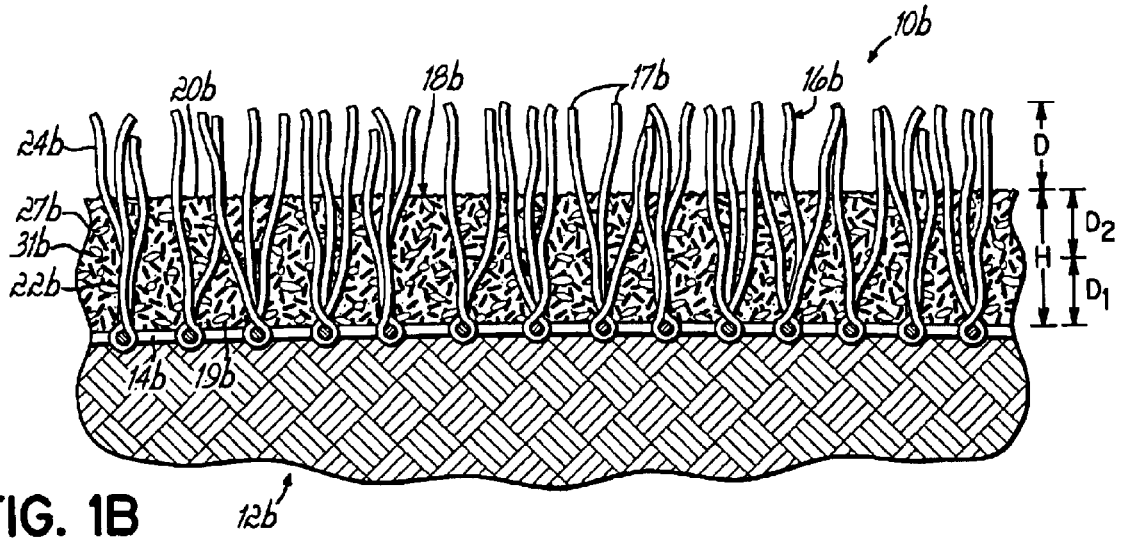
FIG. 1B is a cross-sectional view of one aspect of the filled synthetic turf of the present invention.

Referring to FIG. 1B, a filled synthetic turf 10*b* similar to that of FIG. 1 is illustrated. In this aspect of the present invention, the particulate fill material 18*b* is not divided into layers, but instead is a mixture of ballast particles such as gravel and resilient particles such as crumb rubber. The particulate fill material 18*b* extends upwardly from the backing 14*b* of the turf a height H to an upper surface 20*b* which is located below the tops 17*b* of the pile filaments 16*b*. The particulate fill material 18*b* includes a mixture of ballast particles 27*b* such as gravel and resilient particles 31*b* such as crumb rubber. Other particles may be included if desired.

FIGS. 2A through 2D illustrate alternative aspects of the present invention in which two layers of filled synthetic turf are used for an athletic playing surface. Although two layers of filled synthetic turf are illustrated and described, any number of layers of filled synthetic turf may be used in accordance with the present invention.

Figure 2A:
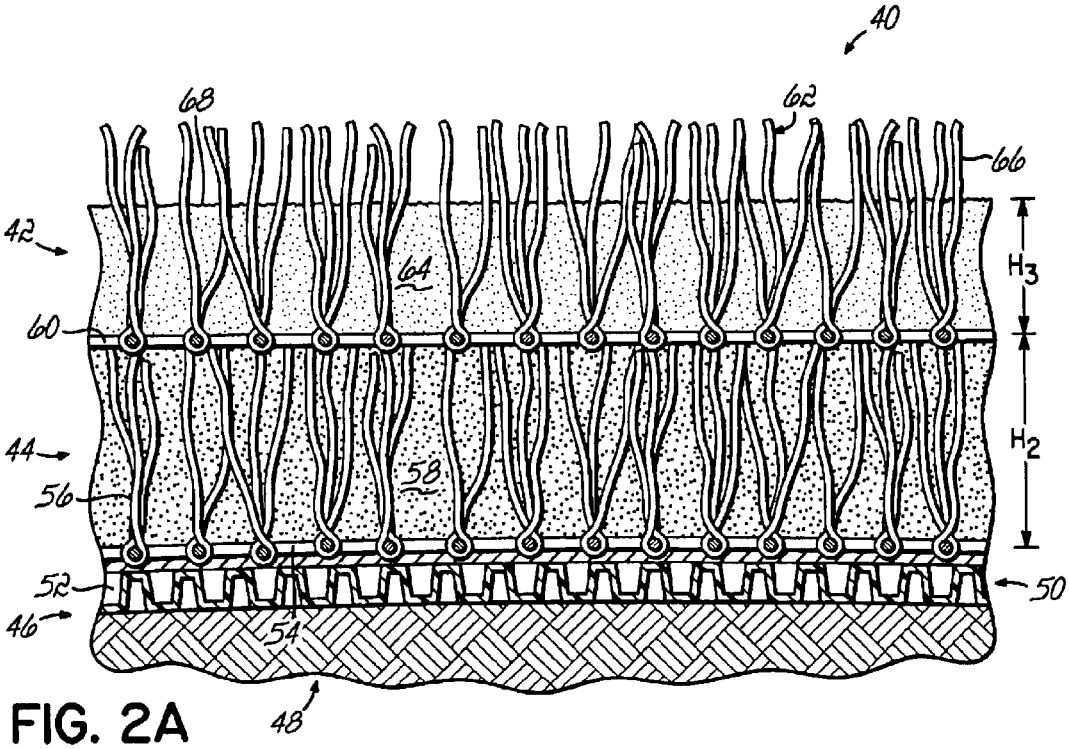
FIG. 2A is a cross-sectional view of another embodiment of the present invention illustrating a filled synthetic turf residing on a subsurface comprising another filled synthetic turf.

FIG. 2A illustrates a filled synthetic turf 40 having an upper surface layer 42 of filled synthetic turf and a lower subsurface layer 44 resting on a foundation 46 and located below the upper surface layer 42 of filled synthetic turf. The foundation 46 comprises a lower portion 48 which is illustrated as being a solid member, but may be crushed stone or any other suitable foundation, and an upper portion 50 which may be one or more drainage members as described hereinabove and illustrated in FIG. 1A. Alternatively, the foundation 46 may be uniform like the foundation 12 illustrated in FIG. 1.

Directly above the foundation 46 is the subsurface layer 44 comprising a subsurface backing 54 having a plurality of subsurface pile filaments 56 secured thereto and extending upwardly therefrom to a desired height $H_2$. The subsurface pile filaments 56 may be tufted or secured in any known manner to the subsurface backing 54. A subsurface fill material 58 resides on the subsurface backing 54 and extends upwardly a distance equal to the height $H_2$ of the subsurface pile filaments 56. However, the height of the subsurface fill material 58 may be any desired height. The subsurface particulate fill material 58 is illustrated as being a homogenous material. However, the subsurface particulate fill material 58 may be layered, a mixture or homogenous with any known or desired particulate fill material.

Referring the FIG. 2A, the surface layer 42 comprises a filled synthetic turf having a surface backing 60 residing on the top of the subsurface layer 44. In addition, a plurality of surface pile filaments 62 are tufted or otherwise secured to the surface backing 60 in any known manner. A surface particulate fill 64 resides on the surface backing 60 to a desired vertical height $H_3$. In the embodiment illustrated in FIG. 2A, the surface particulate fill 64 is a homogenous material including at least some resilient particles such as crumb rubber. However, the surface particulate fill 64 may be any known particles. Each of the surface pile filaments 62 have an upper portion 66 extending above an upper surface 68 of the surface particulate fill 64.

In order to achieve a desired degree of shock absorption, the subsurface layer 44 and more particularly the subsurface pile filaments 56 may be of any desired height. The greater the desired degree of shock absorption, the greater the height of the subsurface layer 44. In addition, the composition of the subsurface particulate fill material may be modified to obtain the desired degree of shock absorption.

Figure 2B:
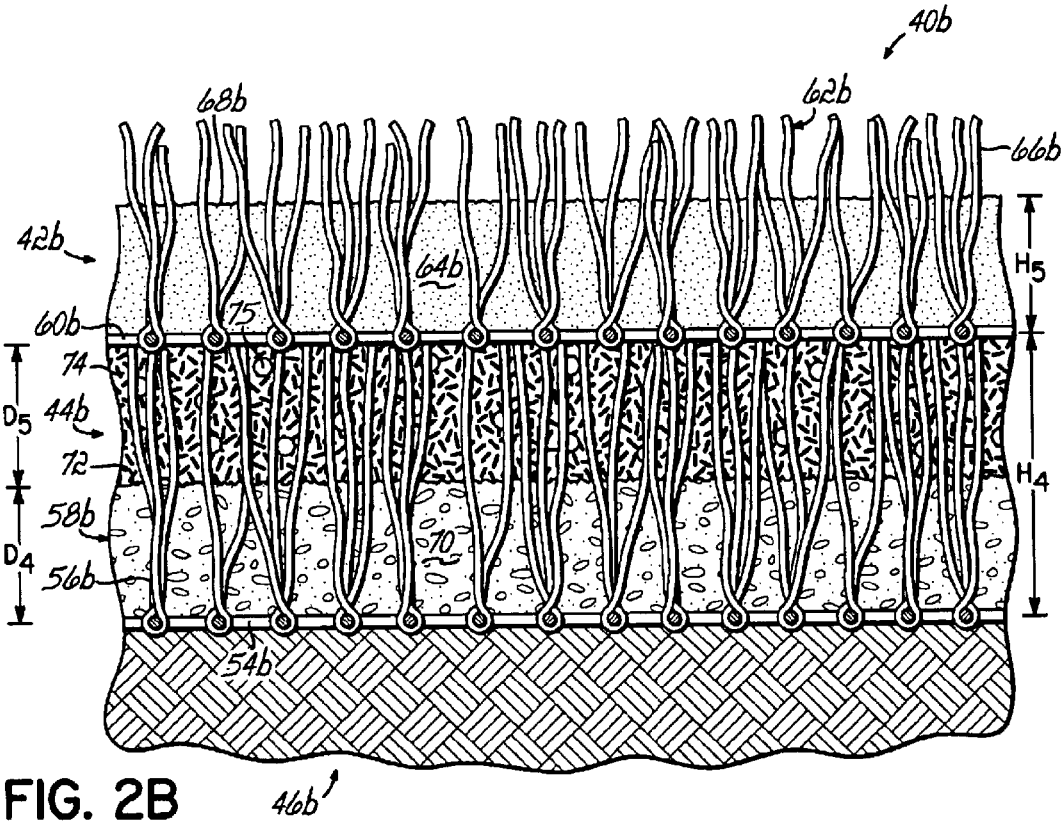
FIG. 2B is a cross-sectional view of another embodiment of the present invention illustrating a filled synthetic turf residing on a subsurface comprising a filled synthetic turf similar to that illustrated in FIG. 1 but including a binder.

FIG. 2B illustrates an alternative embodiment or aspect of the present invention. For the sake of simplicity, this embodiment will utilize the same numbers for corresponding elements as the embodiment illustrated in FIG. 2A, but with a "b" designation after the appropriate numeral.

FIG. 2B illustrates another multi-layered filled synthetic turf 40*b* comprising an upper surface layer 42*b* of filled synthetic turf and a lower subsurface layer 44*b* of filled synthetic turf resting on a foundation 46*b*. The foundation 46*b* is illustrated as being a uniform member, but may have multiple layers which may include one or more drainage members as described and illustrated hereinabove.

Directly above the foundation 46*b* is the subsurface layer 44*b* comprising a subsurface backing 54*b* having a plurality of subsurface pile filaments 56*b* secured thereto and extending upwardly therefrom to a desired height $H_4$. The subsurface pile filaments 56*b* may be tufted or secured in any known manner to the subsurface backing 54*b*. A subsurface fill material 58*b* resides on the subsurface backing 54 and extends upwardly a distance equal to the height $H_4$ of the subsurface pile filaments 56*b*. The subsurface fill material 58*b* includes a first lower layer 70 of gravel located on the subsurface backing 54*b* and extending upwardly from the backing 54*b* a distance $D_4$ to an upper surface 72. A second upper layer 74 of resilient particles rests on the upper surface 72 of the first lower layer 70. The first lower layer 70 provides weight and stability for the subsurface layer and helps hold the subsurface backing 54*b* in its desired location. The second upper layer 74 of resilient particles such as rubber provides resiliency for the upper layer of synthetic filled turf. The second upper layer 74 is of a height $D_5$ extending from the upper surface 72 of the lower layer 70 to the tops of the subsurface pile filaments 56*b*.

In order to hold the subsurface fill material 58*b* in place, a binder 75 is located in the subsurface fill material. The binder 75 is illustrated in FIG. 2B as particles located throughout the second upper layer 74*c* of the subsurface fill material 58*b*. The binder 75 may be pellets of latex or a polyethylene which are activated by water, heat or any other known method. Alternatively, the binder 75 may be layered on top of the subsurface fill material as illustrated in FIG. 2C.

Referring the FIG. 2B, the surface layer 42*b* comprises a filled synthetic turf having a surface backing 60*b* residing on the top of the subsurface layer 44*b*. In addition, a plurality of surface pile filaments 62*b* are tufted or otherwise secured to the backing 60*b* in any known manner and extend upwardly therefrom to a desired height. A surface particulate fill 64*b* resides on the surface backing 60*b* to a desired vertical height $H_5$. The surface pile filaments 62*b* each have an upper portion 66*b* extending above an upper surface 68*b* of the surface particulate fill 64*b*. In the embodiment illustrated in FIG. 2B the surface particulate fill 64*b* is a homogenous material. including at least some resilient particles such as crumb rubber. However, the surface particulate fill 64*b* may be layered with any known or desired particles, preferably including at least some resilient particles for shock absorption.

In order to achieve a desired degree of shock absorption, the subsurface layer 44*b* may be of any desired height and the subsurface particulate fill 58*b* may be of any desired material.

FIG. 2C illustrates an alternative embodiment of the present invention. For the sake of simplicity, this embodiment will utilize the same numbers for corresponding elements as the embodiments illustrated in FIGS. 2A and 2B but with a "c" designation after the appropriate numeral.

FIG. 2C illustrates a multi-layered filled synthetic turf 40*c* comprising a foundation 46*c*, a lower subsurface layer 44*c* of filled synthetic turf resting on the foundation 46*c* and an upper surface layer 42*c* of filled synthetic turf. The foundation 46*c* is illustrated as being a uniform member, but may have multiple layers which may include one or more drainage members as described and illustrated hereinabove.

Directly above the foundation 46*c* is the subsurface layer 44*c* of filled synthetic turf comprising a subsurface backing 54*c* having a plurality of subsurface pile filaments 56*c* secured thereto and extending upwardly therefrom to a desired height $H_6$. The subsurface pile filaments 56*c* may be tufted or secured in any known manner to the subsurface backing 54*c*. A subsurface fill material 58*c* resides on the subsurface backing 54*c* and preferably extends upwardly a distance equal to the height $H_6$ of the subsurface pile filaments 56*c*. The subsurface fill material 58*c* includes a first lower layer 70*c* of gravel located on the subsurface backing 54*c* and extending upwardly from the backing 54*c* a distance $D_6$ to an upper surface 72*c* of the first lower layer 70*c*. A second upper layer 74*c* of resilient particles rests on the upper surface 72*c* of the first lower layer 70*c*. The first lower layer 70*c* provides weight and stability for the subsurface layer and helps hold the subsurface backing 54*c* in its desired location. The second upper layer 74*c* of resilient particles such as rubber provides resiliency for the upper layer of synthetic filled turf. The second upper layer 74*c* is of a height $D_7$ extending from the upper surface 72*c* of the lower layer 70*c* to the tops of the subsurface pile filaments 56*c*.

In order to hold the subsurface fill material in place, a binder 71 is layered on top of the subsurface fill material. The binder 71 is illustrated in FIG. 2C as a polymeric coating layer located on top of the second upper layer 74*c* of the subsurface fill material. The polymeric coating layer may be a urethane sprayed or otherwise applied to the top of the subsurface fill material. However, the binder 71 may be applied using other known methods. Alternatively, the binder 75 may be located throughout the subsurface fill material as illustrated in FIG. 2B.

Referring the FIG. 2C, the surface layer 42*c* comprises a filled synthetic turf having a surface backing 60*c* residing on the top of the subsurface layer 44*c*. In addition, a plurality of surface pile filaments 62*c* are tufted or otherwise secured to the backing 60*c* in any known manner. A surface particulate fill 64*c* resides on the surface backing 60*b* to a desired vertical height $H_7$. The surface pile filaments 62*c* each have an upper portion 66*c* extending above an upper surface 68*c* of the surface particulate fill 64*c*.

The surface particulate fill 64*c* is illustrated in FIG. 2C as a having two layers, a lower layer 76 and an upper layer 78. However, the surface particulate fill 64*c* may comprise any number of layers of fill or be homogenous material as illustrated in FIG. 2B. The surface fill material 64*c* includes a first lower layer 76 of gravel located on the surface backing 60*c* and extending upwardly from the surface backing 60*c* a distance $D_8$ to an upper surface 77. A second upper layer 78 of resilient particles rests on the upper surface 77 of the first lower layer 76. The first lower layer 76 provides weight and stability for the subsurface layer and helps hold the surface backing 60*c* in its desired location. The second upper layer 78 of resilient particles such as rubber provides resiliency for the upper layer 42*c* of synthetic filled turf. The second upper layer 78 is of a height $D_9$ extending from the upper surface 77 of the lower layer 76 to an upper surface 68*c* spaced below the tops of the surface pile filaments 62*c*.

In order to achieve a desired degree of shock absorption, the subsurface layer 44*c* may be of any desired height and the subsurface particulate fill 58*c* may be of any desired material.

FIG. 2D illustrates the multi-layered filled synthetic turf illustrated in FIG. 2A. In addition, hollow tubing 82 extends through the subsurface layer 44. The tubing 82 comprises an exterior wall 84 having a hollow interior 86 such that fluid (not shown) may flow through the tubing 82. The tubing 82 resides within the subsurface fill material above the subsurface backing and below the tops of the subsurface pile filaments. The tubing 82 is adapted to be operatively connected to a pump to convey fluid through the tubing 82 to selectively heat or cool the subsurface, thereby heating or cooling the surface layer 42 of the mult-layered filled synthetic turf.

Figure 3A:
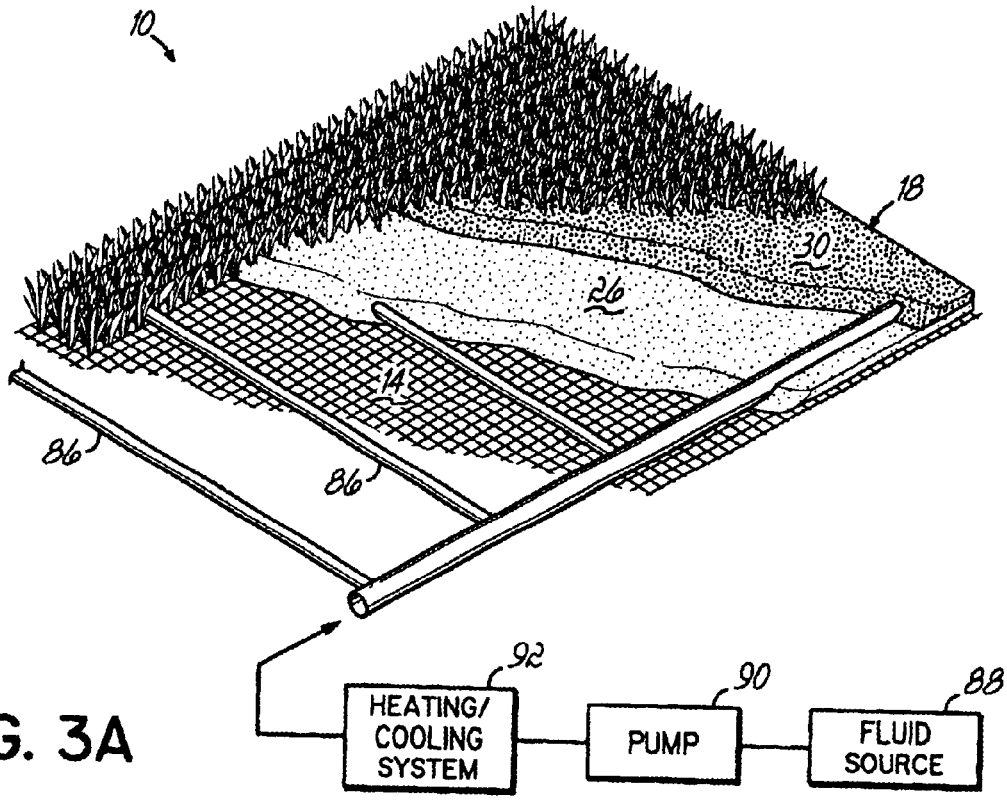
FIG. 3A is a perspective view of an alternative embodiment of the present invention, illustrating a filled synthetic turf having tubing extending therethrough.

FIG. 3A illustrates yet another aspect of the present invention. In this embodiment of the present invention, any filled synthetic turf may be heated or cooled. FIG. 3A illustrates the filled synthetic turf of FIG. 1 having two layers of particulate fill material. For the sake of simplicity, the numerals used to describe the embodiment illustrated in FIG. 1 are repeated. Multiple interconnected tubes 86 are operatively connected to a fluid source 88 which contains water or air, for example. A pump 90 or other suitable structure conveys or forces fluid (not shown) from the fluid source 88 into the tubes 86. A heating/cooling system 92 heats or cools the fluid to the appropriate temperature. Although the tubes 86 are illustrated as being in one configuration or arrangement, they may assume any desired configuration, such as a serpentine configuration.

The tubes 86 are illustrated as passing through the first lower layer 26 of gravel within the particulate fill material 18. However, the tubes 86 may pass through the upper layer 30 of resilient particles or through both layers, if desired. Alternatively, if a homogenous particulate fill material is used rather than a layered particulate fill material, the tubes may be located at any desired depth therein.

Figure 3B:
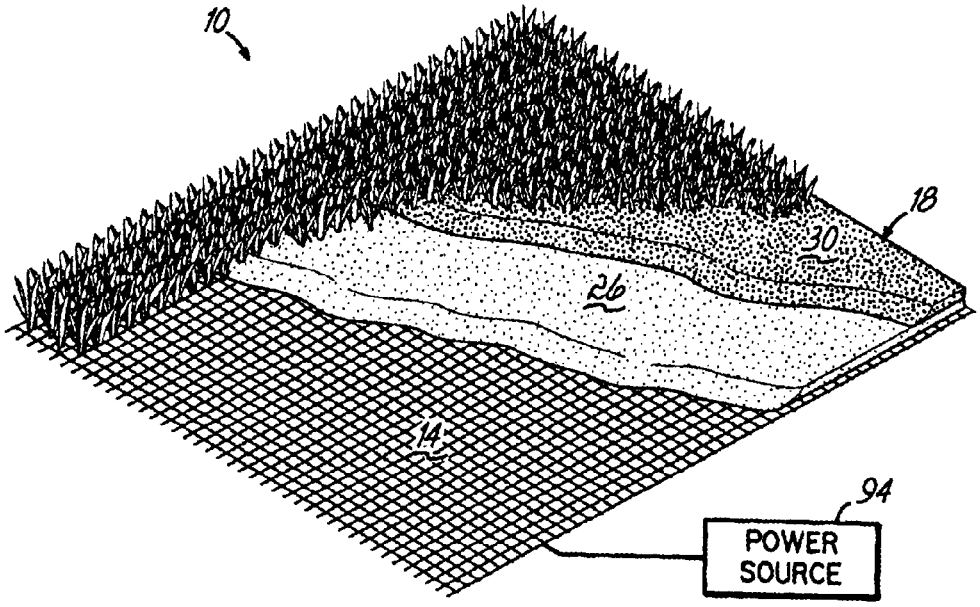
FIG. 3B is a perspective view of an alternative embodiment of the present invention, illustrating a filled synthetic turf being heated by a heat source via the backing of the synthetic turf.
Figure 3A:
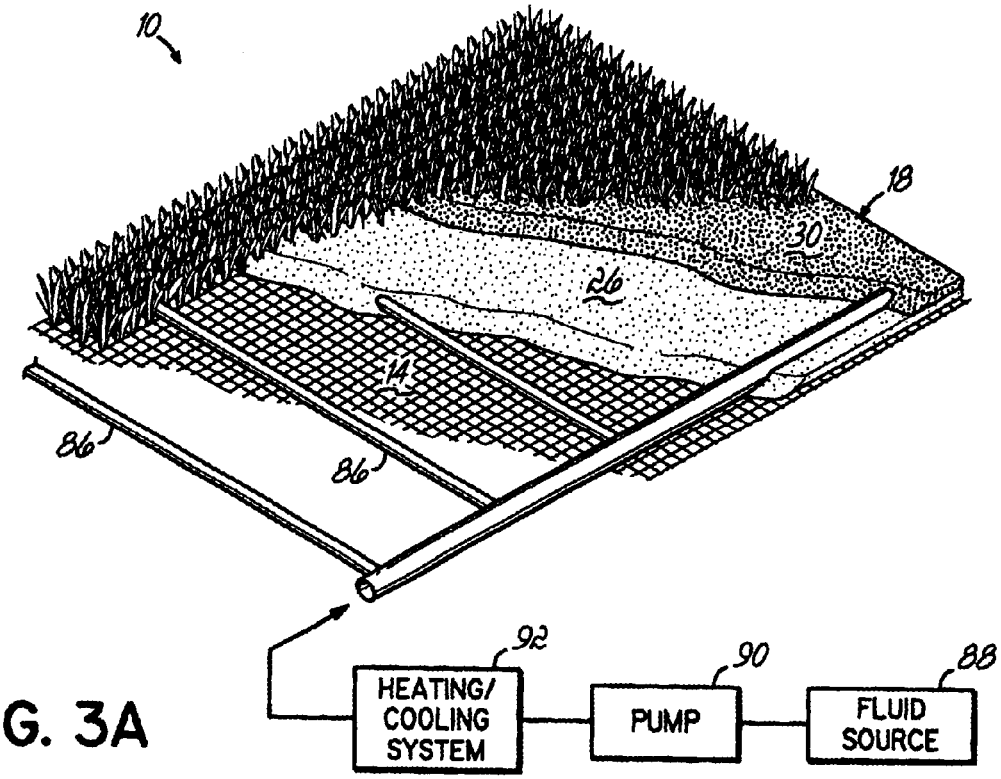
Figure 3B:
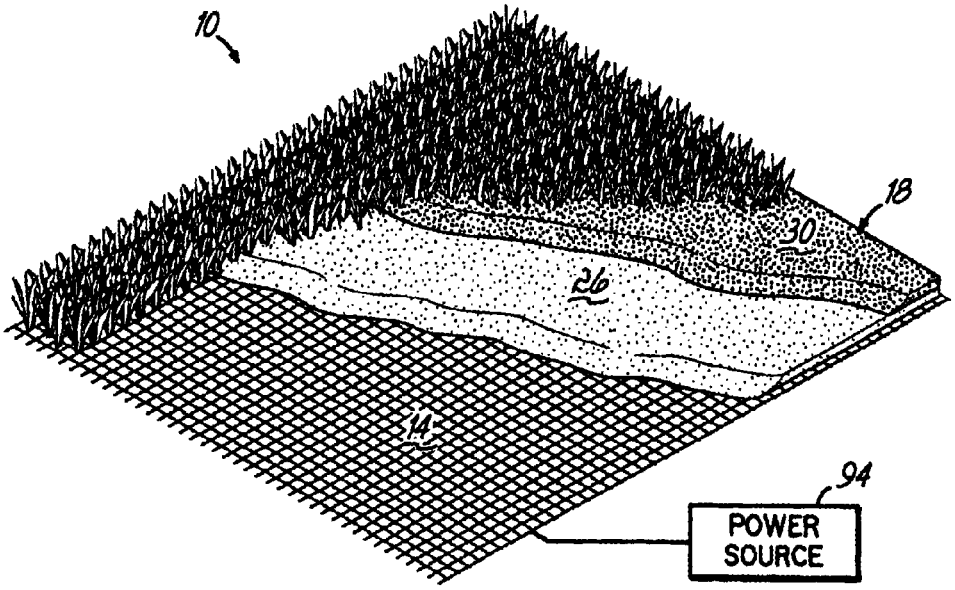

FIG. 3B illustrates yet another aspect of the present invention. In this embodiment of the present invention, any filled synthetic turf may be heated. FIG. 3B illustrates the filled synthetic turf of FIG. 1 having two layers of particulate fill material. For the sake of simplicity, the numerals used to describe the embodiment illustrated in FIG. 1 are repeated. To heat the filled synthetic turf 10, the backing 14 is operatively connected to a power source 94 which supplies energy to heat the backing 14. This method of heating the filled synthetic turf may be used with any type of synthetic turf having a backing, regarding of the particulate fill material.

In use, unfilled synthetic turf is unrolled in strips on a foundation where the athletic playing surface is to be located. The strips are preferably 8 feet in width but may be any desired width. Adjacent strips are sewn or joined together along the longitudinal edges thereof using any conventional means. More particularly, the backing of the synthetic turf is placed on the foundation and/or a drainage member. The pile filaments are moved or urged into a generally vertical orientation extending upwardly from the backing.

The particulate fill material is then placed on the backing to a desired vertical height. The pile filaments of the synthetic turf extend above the upper surface of the fill material. The particulate fill material is applied in layers. The first lower layer of gravel is first located on the backing in a quantity sufficient to extend upwardly from the backing to a desired height. The second upper layer of resilient particles is then located on top of the first lower layer of gravel in a quantity sufficient to extend upwardly from the first lower layer to a desired height.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A filled synthetic turf comprising:

a foundation;

a backing residing on the foundation;

a plurality of grass-like pile filaments secured to the backing and extending generally upwardly therefrom; and a particulate fill material residing on the backing to a desired height, the pile filaments extending above the fill material, the fill material including, a first lower layer of gravel located on the backing and a second upper layer of resilient particles, wherein the first lower layer provides weight for holding the backing and the second upper layer provides resiliency for the synthetic turf.

2. The filled synthetic turf of claim 1 wherein the pile filaments comprise synthetic ribbons of selected length.

3. The filled synthetic turf of claim 1 wherein the first lower layer comprises pea gravel.

4. The filled synthetic turf of claim 1 wherein the second upper layer comprises synthetic particles.

5. The filled synthetic turf of claim 4 wherein the synthetic particles are rubber.

6. The filled synthetic turf of claim 1 wherein the height of the first lower layer is about equal to the height of the second upper layer.

7. The filled synthetic turf of claim 1 wherein said backing residing on the foundation is water permeable.

8. A filled synthetic turf comprising:

a foundation;

a backing residing on the foundation;

a plurality of grass-like pile filaments secured to the backing and extending generally upwardly therefrom; and a particulate fill material residing on the backing to a desired height, the pile filaments extending above the fill material, the fill material including, a first lower layer of gravel located on the backing and a second upper layer of resilient particles, wherein the first lower layer provides weight for holding the backing and the second upper layer provides resiliency for the synthetic turf;

a subsurface residing between the foundation and the backing, the subsurface including:

a subsurface backing with a plurality of subsurface pile filaments extending upwardly therefrom to a desired height;

a subsurface fill material residing on the subsurface backing to a desired vertical level relative to the desired height of the subsurface pile filaments including at least some resilient particles; and a polymeric coating applied to the subsurface fill material and the subsurface pile filaments to hold the subsurface fill material in place.

9. The filled synthetic turf of claim 8 wherein the composition of the subsurface fill material and the desired height of the subsurface pile filaments are selected to achieve a desired degree of shock absorption for the subsurface and for the synthetic turf located thereabove.

10. The filled synthetic turf of claim 8 wherein subsurface fill material includes gravel in combination with the resilient particles.

11. The filled synthetic turf of claim 8 wherein the subsurface further comprises:

tubing residing within the subsurface fill material above the subsurface backing and below the tops of the subsurface pile filaments, the tubing adapted to be operatively connected to a pump to convey fluid within the tubing to selectively heat or cool the subsurface, to thereby heat or cool the filled synthetic turf.

12. A filled synthetic turf comprising:

a foundation;

a drainage member residing on the foundation;

a water permeable backing residing on the drainage member;

a plurality of grass-like pile filaments secured to the backing and extending generally upwardly therefrom; and a particulate fill material residing on the backing to a desired height, the pile filaments extending above the fill material, the fill material including, a first lower layer consisting essentially of gravel located on the backing and a second upper layer of resilient particles, wherein the first lower layer provides weight for holding the backing and the second upper layer provides resiliency for the synthetic turf.

13. The filled synthetic turf of claim 12 wherein said pile filaments are grass-like fibers.

14. The filled synthetic turf of claim 12 wherein said gravel comprises particles having a diameter greater than 2 milimeters.

15. A method of constructing a filled synthetic turf on a foundation, comprising:

placing a backing on the foundation, a plurality of pile filaments being secured to the backing and extending generally upwardly therefrom;

filling a particulate fill material on the backing to a desired height, the pile filaments extending above the fill material, the first layer of fill material consisting essentially of gravel; and filling a second layer of particulate fill material on the first layer of particulate fill material to a desired height, the pile filaments extending above the second layer of particulate fill material, the second layer of particulate fill material including resilient particles.

16. A method of constructing a filled synthetic turf on a foundation, comprising:

placing a drainage member on the foundation, placing a water permeable backing upon the foundation, a plurality of pile filaments being secured to the backing and extending generally upwardly therefrom;

filling a particulate fill material on the backing to a desired height, the pile filaments extending above the fill material, the fill material including a first lower layer consisting essentially of gravel located on the backing and a second upper layer of resilient particles, wherein the first lower layer provides weight for holding the backing on the foundation and the second upper layer provides resiliency for the synthetic turf.

17. An athletic surface comprising:

a foundation;

a subsurface layer supported by the foundation and a surface layer comprising a filled synthetic turf supported by the subsurface layer, the subsurface layer comprising a subsurface flexible backing with a plurality of grass-like subsurface pile filaments extending generally upwardly therefrom to a desired height;

a subsurface fill material residing on the subsurface backing, the subsurface fill material including at least some rubber particles, wherein the composition of the subsurface fill material and the desired height of the subsurface pile filaments are selected to achieve a desired degree of shock absorption for the surface; and a tubing circuit residing within the subsurface fill material above the subsurface backing and below the tops of the subsurface pile filaments, the tubing circuit adapted to convey fluid within the subsurface tubing circuit, thereby to selectively heat or cool the subsurface layer.

18. The athletic surface of claim 17 wherein the filled synthetic turf of the surface layer comprises a surface backing residing on the subsurface layer and a plurality of pile filaments secured to the surface backing and extending generally upwardly therefrom, and a particulate surface fill material residing on the surface backing to a desired height, the surface pile filaments extending above the surface fill material.

19. The athletic surface of claim 18 wherein the surface fill material includes at least one layer of gravel located on the surface backing.

20. The athletic surface of claim 17 and further comprising, a binder holding the subsurface fill material and the subsurface pile filaments together in place and holding the subsurface fill material and the subsurface pile filaments to the subsurface backing.

21. The athletic surface of claim 20 wherein the binder is a polymeric binder.

22. The athletic surface of claim 17 wherein the foundation includes at least one layer of drainage members.

23. An athletic surface comprising:

a foundation;

a drainage member residing on the foundation;

a subsurface layer supported by the foundation and a surface layer comprising a filled synthetic turf supported by the subsurface layer, the subsurface layer comprising a subsurface flexible backing with a plurality of grass-like subsurface pile filaments extending generally upwardly therefrom to a desired height;

a subsurface fill material residing on the subsurface backing, the subsurface fill material including at least some rubber particles, wherein the composition of the subsurface fill material and the desired height of the subsurface pile filaments are selected to achieve a desired degree of shock absorption for the surface.

24. The athletic surface of claim 23 wherein the surface fill material includes at least one layer of gravel located on the surface backing.

25. The athletic surface of claim 23 wherein the subsurface fill material includes at least one layer of gravel located on the subsurface backing.

26. A filled synthetic turf comprising:

a foundation;

a subsurface backing residing supported by the foundation with a plurality of subsurface pile filaments extending upwardly therefrom to a desired height;

a subsurface fill material residing on the subsurface backing to a desired vertical level relative to the desired height of the subsurface pile filaments including at least some resilient particles; and a polymeric coating applied to the subsurface fill material and the subsurface pile filaments to hold the subsurface fill material in place;

a surface backing residing on the subsurface fill material;

a plurality of grass-like pile filaments secured to the surface backing and extending generally upwardly therefrom; and a particulate surface fill material residing on the surface backing to a desired height, the pile filaments extending above the surface fill material, the surface fill material including at least some resilient particles.

27. An athletic surface comprising:

a foundation;

a subsurface layer supported by the foundation and a surface layer comprising a filled synthetic turf supported by the subsurface layer, the subsurface layer comprising a subsurface flexible backing with a plurality of grass-like subsurface pile filaments extending generally upwardly therefrom to a desired height;

a subsurface fill material residing on the subsurface backing, the subsurface fill material including at least some rubber particles, wherein the composition of the subsurface fill material and the desired height of the subsurface pile filaments are selected to achieve a desired degree of shock absorption for the surface; and means for heating or cooling the subsurface layer.

* * * * *

UNITED STATES PATENT AND TRADEMARK OFFICE

CERTIFICATE OF CORRECTION

PATENT NO. : 6,800,339 B2 
DATED : October 5, 2004
INVENTOR(S) : Joseph E. Motz, Mark A. Heinlein and Stephen L. Linville It is certified that error appears in the above-identified patent and that said Letters Patent is hereby corrected as shown below:

Column 5,
Line 9, replace “turf;” with -- turf. --.

Column 6,
Line 51, replace “Referring the FIG.” with -- Referring to FIG. --.

Column 7,
Line 46, replace “Referring the FIG.” with -- Referring to FIG. --.

Column 8,
Line 45, replace “Referring the FIG.” with -- Referring to FIG. --.
Line 55, replace “a having two” with -- having two --.

Column 9,
Line 19, replace “mult-layered” with -- multi-layered --.
Line 53, replace “regarding” with -- regardless --.

Column 10,
Line 26, replace “a first lower layer of gravel located on” with -- a first lower layer consisting essentially of gravel located on --.

Column 11,
Line 41, replace “milimeters.” with -- millimeters. --.
Lines 46-47, replace “filling a particulate fill material on the backing to a desired height, the pile filaments extending above the fill material, the first layer” with -- filling a first layer of particulate fill material on the backing to a desired height, the pile filaments extending above the first layer --.

Signed and Sealed this

Eighth Day of November, 2005

JON W. DUDAS
*Director of the United States Patent and Trademark Office*